United States Patent [19]

Morton

[11] 3,983,999

[45] Oct. 5, 1976

[54] MULTI-CONTAINER PACKAGE

[76] Inventor: Jay Morton, Apt. 2004 "Winston Towers 500" Intercoastal at 174th St., Miami Beach, Fla. 33160

[22] Filed: May 23, 1975

[21] Appl. No.: 580,282

[52] U.S. Cl. ..... 206/498; 206/526; 206/820; 229/51 DB

[51] Int. Cl.[2] ..... B65D 5/54

[58] Field of Search ..... 206/526, 498, 820, 484; 220/23.4; 229/51 DB, 43

[56] References Cited

UNITED STATES PATENTS

| | | | |
|---|---|---|---|
| 2,214,525 | 9/1940 | De Murgurondo | 229/51 DB |
| 2,752,037 | 2/1951 | Vogt | 206/820 |
| 2,984,346 | 5/1961 | Holley | 206/820 |
| 3,021,001 | 2/1962 | Donofrio | 220/23.4 |
| 3,168,193 | 2/1965 | Schechter | 220/23.4 |
| 3,302,854 | 2/1967 | Midgley et al. | 229/43 |
| 3,389,825 | 6/1968 | Whiteford | 206/526 |
| 3,780,856 | 12/1973 | Brauerman | 206/484 |

*Primary Examiner*—William T. Dixson, Jr.

[57] ABSTRACT

A multi-container package for articles, such as orange juice in a frozen state, which includes a lid panel separated by divider zones or perforated zones into equispaced lid portions and a container means suspended beneath each lid portion and including sealing means to hold the lid portions to the container means.

6 Claims, 4 Drawing Figures

MULTI-CONTAINER PACKAGE

FIELD OF THE INVENTION

This invention relates to packaging and, more particularly, to a multi-container package, such as one which might be used for frozen orange juice.

BACKGROUND OF THE INVENTION

In the past many items, such as orange juice, have been marketed in containers which are individual, such as round cans. Such cans when opened in a conventional manner present on obstacle to the removal of frozen contents, such as orange juice, because they become hung up on the edge of the opening. Also, it is quite often difficult to store the containers since each one is separate. It is an object of this invention to provide a multi-container package, which might be aptly termed as a "six pack" and which includes a common lid panel and container means arranged beneath the lid panel so that, in effect, the lid panel is separated into separate lid portions, with each lid portion covering one of the containers but all of the containers and lid portions being interconnected along weakened divider zones, so that separate containers with their lid portion sealed thereto may be separated from the package and the contents removed. It is also an object to provide a container of the type described hereinbefore which includes downwardly converging side and end walls so that the contents when in a solid state, i.e., frozen orange juice, may be readily removed from the container after the lid portion has been removed.

It is a general object of this invention to provide an improved multi-container package which may be composed of plastic containers which are interconnected and which are provided with a lid panel in sealing relation of the mouth of the container or which may, alternatively, be of foil material or, indeed, of cardboard or other panel-type material which is folded so that the individual containers of the package are provided with a wall which is part of a panel or panels which are common to all of the containers of the package as is described more fully hereinafter. It is an overall object of this invention to provide a simple and inexpensive packaging means for a plurality of containers, so that they may be marketed in multi-container packages for separate use of the containers as required by the purchaser and which is simple and inexpensive to manufacture and from which the contents may be easily and readily removed and which may be of foil, plastic or other panel material with a lid sealed thereto which is readily removed for use.

DETAILED DESCRIPTION OF THE DRAWINGS

Figure 1:
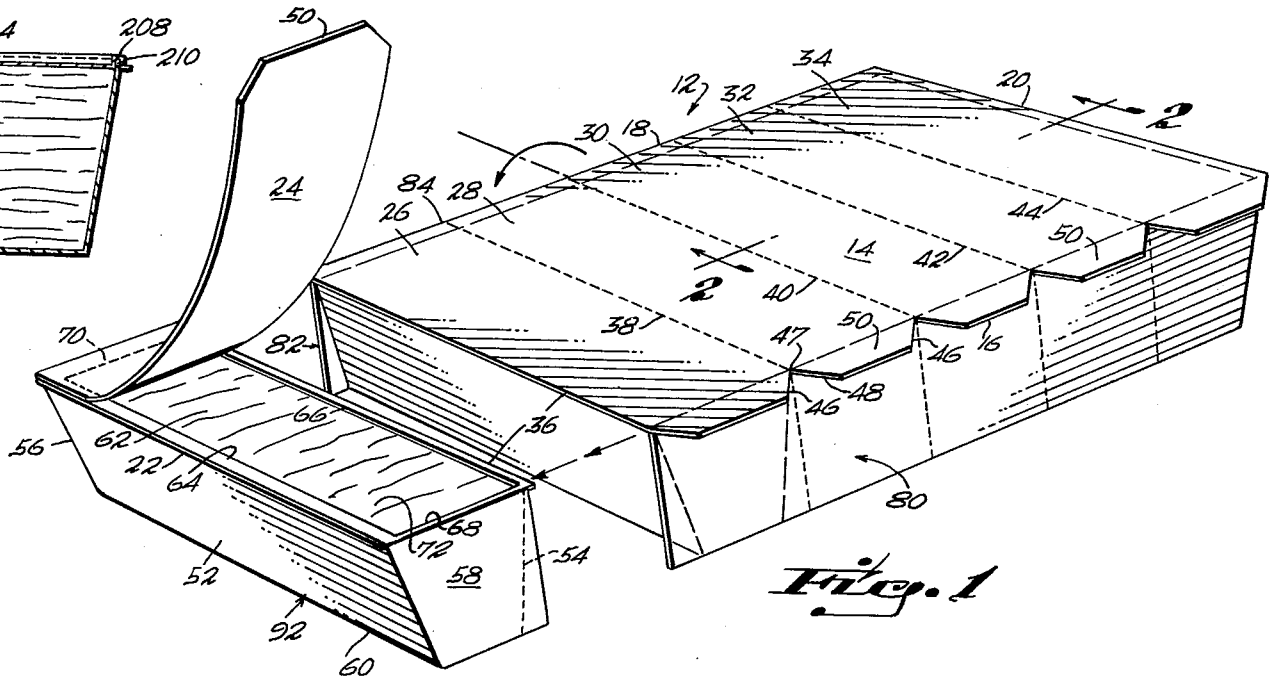
FIG. 1 is a perspective view of the multi container package, one of which has been broken away for illustrative purposes.

The numeral 12 generally designates the multi-container package which, in the preferred embodiment, is composed of six containers. The package 12 includes a common lid 14 which has front, rear and side edges 16, 18, 20 and 22 and is composed of six interconnected parallel lid panels 24, 26, 28, 30, 32 and 34 with their main surfaces being coplanar and with the adjacent lid panels being interconnected along parallel weakened or perforated divider zones, 36, 38, 40, 42 and 44, which extend from the front edge 16 to the rear edge 18. Preferably the front edge is provided with angular cutouts therealong defining return edges as at 46 and 48 which converge from the front edge of the lid to a vertex 47 at each of the divider zones with the extending tapered front edge margin comprising a tab, such as 50, for use in peeling the lid panel as shown in FIG. 1 with respect to the left-hand container. The tab may be folded downwardly if desired for compactness.

An individual container is suspended in depending relation beneath each lid panel. Each container includes opposing and converging side and end walls, 52, 54, 56 and 58, i.e., the opposing walls of each container converge toward a floor 60 from their respective open mouths, such as 62, bounded by the upper edges 64, 66, 68 and 70 of the walls at the lid level. The side walls of adjacent containers abut the lid on opposite sides of the divider zones and each is adapted to be separately severed from the multi-container package by tearing it along the respective divider zones from the package in chief.

The lid is connected to the upper terminal face of the container walls by suitable means; and, as shown in FIG. 1, the lid panel of an individual container may be peeled from the end face to gain access to the contents. For example, a frozen orange juice plug 72 may be pressed out of the mouth readily after the lid has been removed. The container may be of metal foil so as to be highly conductive of heat; and, when such an individual container is held in warm water for a brief period of time, the plug will readily fall free once the lid panel has been removed.

Figure 3:
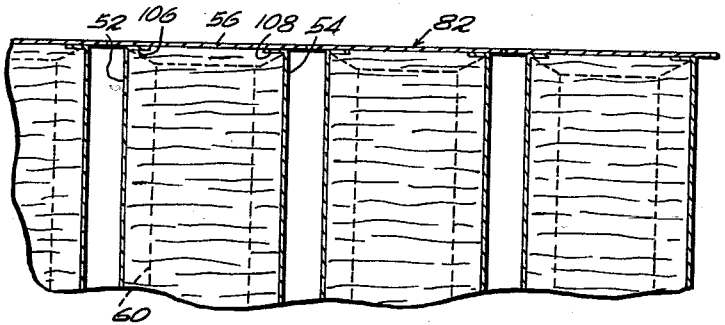
FIG. 3 is a plan view taken on the plane indicated by the line 3—3 of FIG. 2 and looking in the direction of the arrows.
Figure 2:
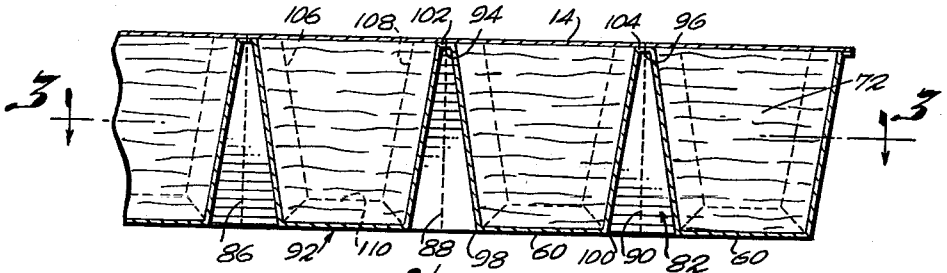
FIG. 2 is a view in cross section taken on the plane indicated by the line 2—2 of FIG. 1 and looking in the direction of the arrows.

In the preferred embodiment illustrated in FIGS. 1–3, each of the end walls of the package are part of an end panel such as the front end panel 80 which is common to all of the containers of the package. The rear end wall 82 may be an extension of the lid and be connected to it along the fold lines as at 84. The common forward and rear end walls 80 and 82 are perforated at divider zones between the containers as at 86, 88, and 90, see FIG. 2, for separating them individually from the package.

The side walls and floor of the package may be included in a common panel 92, which is separated by divider zones or weakened perforated lines as at 94 and 96 in FIG. 2 for complete separation of the container from the package. The parallel fold lines as at 98 and 100 of the panel 92 define the juncture between the floor and the respective adjacent side walls of each container. Preferably the walls of each container are provided with outturned peripheral flanges as at 102 and 104, the perforated divider zones between adjacent packages registering with the perforated divider zones of the lid in assembly. Also, on the floor portion and side wall portions of the common panel 92, outturned flap means are provided to overlay the end walls, the flap means on the wall portions being designated by the numerals 106 and 108 as seen in FIGS. 2 and 3 while the flap means on the floor are designated by the numeral 110 such as in FIG. 2.

Figure 4:
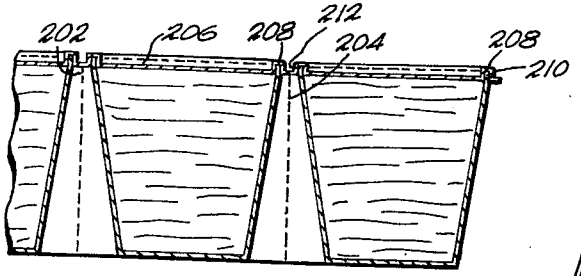
FIG. 4 is a view similar to FIG. 2 and illustrating an alternative embodiment of the instant invention.

In the preferred embodiment of FIG. 1, it is thus seen that an individual container may be separated from the package as indicated by the arrowed lines by tearing it along the perforated edges and thereafter removing the lid, which may have a peripherally perforated central zone which may readily be lifted so that the contents are exposed and may be removed. The overlaying portions of the adjacent panels may be heat sealed together and, to this end, a thin coating of thermosetting plastic material may be applied to the confronting zones of the panels so that, upon application of heat, there is a seal accomplished. Also, the containers may be of one-piece construction of molded plastic material, or as shown in the alternative embodiment of FIG. 4. The common end walls may be weakened along the lines 204 and the lid as at 202 of adjacent panels, so that they may be separated from one another. In the embodiment shown in FIG. 4, the lids such as 206 may be provided with a peripheral recess as at 208 to nest over the upper end of the walls, as at 210 and 212. As an alternative, the container and the lids may be of foil material formed in the shape shown in the drawing and crimped together for sealing the lid to the container after it has been filled with selected contents. For convenient storage the containers may be folded about the arrowed arcuate line in FIG. 1 so that the lid portions of some of the containers of the package overlay the others of the package. In a preferred embodiment the lid portion and containers may be constructed of what is known in the field as foil laminated paper or board container, e.g., folded or deformed sheets of fibrous material of the class which includes paper or paperboard with an exteriorly laminated layer of thin metallic foil.

What is claimed is:

1. A multi-container package comprising a generally planar lid panel having a front, rear and side edges and spaced weakened divider zones extending between the front and rear edges in parallel spaced relation for separating the lid into separate equi-sized lid portions, a container suspended beneath each lid portion and means interconnecting the lid portions of each of the container means and said means interconnecting including sealing means, each of said container means including downwardly converging side walls and a first and a second opposed end wall and all of said first end walls being in a common panel and all of said second end walls being in a common panel, said walls being spanned by a floor and said walls being connected to the lid panel, and said wall panels are provided with divider zones between each container means for separation of the container means from the multi-container package; and wherein the sealing means comprise a coating of thermosetting resin material which has been cured between the lid panel and the adjacent surfaces of the container means.

2. The device as set forth in claim 1 wherein each lid portion includes tab means for removal of the lid portion for access to the contents of the container means.

3. The device as set forth in claim 1 wherein the container means are of foil material.

4. The device as set forth in claim 1 wherein the container means are of rigid plastic material.

5. The device as set forth in claim 1 wherein each of the container means includes a panel which is common to all of the container means of the package and which is folded defining side walls and a floor for each container, and divider means between adjacent container means for separation of individual container means from the package in the panel.

6. The device as set forth in claim 1 wherein the package is of a deformed sheet of fibrous material of the class which includes paper and paperboard with an exteriorly laminated foil layer.

* * * * *